US005536003A

United States Patent [19]

Brenner

[11] Patent Number: 5,536,003

[45] Date of Patent: Jul. 16, 1996

[54] BASKETBALL SHOT MAKING GAME

[76] Inventor: Reeve R. Brenner, 809 Veirs Mill Rd., Rockville, Md. 20851

[21] Appl. No.: 355,162

[22] Filed: Dec. 8, 1994

[51] Int. Cl.[6] ..... A63B 63/08

[52] U.S. Cl. ..... 273/1.5 R; D21/201; 273/402

[58] Field of Search ..... 273/1.5 R, 1.5 A, 273/402, 400, 854, 398; D21/201

[56] References Cited

U.S. PATENT DOCUMENTS

| | | | |
|---|---|---|---|
| D. 227,884 | 3/1985 | Offutt | D21/201 |
| D. 349,933 | 8/1994 | Offutt | D21/201 X |
| 1,510,402 | 9/1924 | Hopwood . | |
| 2,194,786 | 8/1940 | Chervenka et al. . | |
| 2,504,818 | 4/1950 | Findon | 273/402 |
| 2,786,678 | 3/1957 | Fink . | |
| 3,035,838 | 6/1962 | Johnston . | |
| 3,050,304 | 8/1962 | Hulsebus . | |
| 3,130,971 | 4/1964 | Boccardi et al. | 273/402 X |
| 3,388,909 | 6/1968 | Woods . | |
| 3,477,714 | 11/1969 | Garlington . | |
| 3,578,326 | 5/1971 | Brown | 273/398 X |
| 3,599,981 | 8/1971 | Zausmer . | |
| 3,709,489 | 1/1973 | Holleran et al. . | |
| 3,761,089 | 9/1973 | Slane . | |
| 3,901,506 | 8/1975 | Caveney . | |
| 3,910,575 | 10/1975 | Miller . | |
| 3,951,409 | 4/1976 | Drohomirecky . | |
| 4,036,494 | 7/1977 | Hayes . | |
| 4,079,937 | 3/1978 | Kirsch | 273/85 H |
| 4,239,214 | 12/1980 | Brenner . | |
| 5,125,651 | 6/1992 | Keeling et al. | 273/1.5 R |

FOREIGN PATENT DOCUMENTS

| | | | |
|---|---|---|---|
| 406063189 | 3/1994 | Japan | 273/1.5 R |

OTHER PUBLICATIONS

KBA Basketball Coaching and Training Aids 1989 School Mail Order Catalog, p. 17, KBA 11" Rebound Ring.

1993 Summer Edition Sportime Catalog, pp. 131 & 170, Rimball Goals & Heavy Duty Floating Basketball.

*Primary Examiner*—Paul E. Shapiro

*Attorney, Agent, or Firm*—Howard L. Rose

[57] ABSTRACT

A basketball shot making game having a plurality of angularly related panels in an array with the last of the panels having a diagonal flap directed inwardly toward a netless hoop and a hoop structure of different diameters located on the floor in a position such that a properly directed basketball bounced serially off the array of panels and subsequently the flap and through the netless hoop may enter one of the hoops of a hoop structure located on the floor. The hoop structure may comprise three hoops, a regulation size hoop, a second hoop of lesser diameter coaxial and dispersed a regulation net distance from the first hoop and a third hoop may be provided coaxial with interiorly of and supported by and of lesser diameter than the second hoop.

10 Claims, 2 Drawing Sheets

BASKETBALL SHOT MAKING GAME

FIELD OF THE INVENTION

The present invention relates to a basketball shot making game and more particularly to a backboard and hoop arrangement wherein different size hoops are available.

BACKGROUND OF THE INVENTION

In Applicant's prior patent, U.S. Pat. No. 4,239,214, there is provided a backboard structure providing surfaces at various angles relative to one another and to a hoop of a standard diameter. The object of the game is make a basket by bouncing the ball off of areas of the backboard having different angles relative to the hoop. The different surfaces may be curved or straight, and may be along the sides of, over or behind the hoop.

Upon repeated play, an individual can become somewhat proficient in making a basket since all elements of the game are fixed relative to one another and the hoop is of standard dimensions.

OBJECTS OF THE INVENTION

It is a primary object of the invention to provide a basketball shot making game having hoops of different sizes and permit the hoops to be located at different locations relative to the backboards.

It is another object of the present invention to provide a hoop structure providing a plurality of hoop diameters.

Still another object of the present invention is to provide a hoop and backboard structure wherein the hoop structure may be located at various positions on the playing surface and with different hoop diameters at the entry to the hoop structure.

Yet another object of the present invention is to provide a backboard and hoop structure for a basketball shot making game; the backboard structure having a flap that must be struck at a particular angle to permit entry through an upper hoop into the hoop of the present invention located at floor level.

BRIEF DESCRIPTION OF THE PRESENT INVENTION

The present invention employs the backboard structure of the aforesaid patent, the structure including a regulation size hoop without netting located relative to the backboard as in said patent. The backboard specifically includes in one form three angularly related generally rectangular panels and a fourth panel angularly related to the panel to which it is connected at one end of a horizontally serial array of panels with an end edge region turned at an angle along, say a 45° line, relative to said last-mentioned panel. A hoop is located centrally of such backboard structure as in the prior patent with however, the netting removed. The description of the backboard and hoop structure, particularly FIGS. 1B and 9, of U.S. Pat. No. 4,239,214 is incorporated herein by reference.

In accordance with the present invention a further hoop structure is located on the floor, that is, at the same level as the feet of the player. This hoop structure is movable to different locations on the floor and to accommodate variations of the angled entry of the ball after deflection. The hoop structure comprises in effect three hoops. One hoop is of a regulation size and is connected by rigid members to a hoop at a distance along the axis of the structure from the first mentioned hoop. This latter hoop is coaxial with the first hoop and has a smaller diameter than the hoop at the other end of the hoop structure. A third hoop of still smaller diameter is removably mounted within the last-mentioned hoop.

There is thus provided a hoop structure on the floor which is movable to any position on the floor relative to the backboard and upper hoop arrangement. The hoop structure provides various diameter hoops from regulation size at one end to one at the other end that is only slightly larger in diameter than a regulation basketball. The hoop structure may be set with the large or the small end up.

The object of the game is to bounce the ball off of at least one and preferably the first three panels of the backboard in succession, thence against the turned edge of the last panel (hereinafter referred to as a "flap") through the upper hoop and into the upper hoop of the hoop structure located on the floor, the lower hoop structure.

The above and other features, objects and advantages of the present invention, together with the best means contemplated by the inventor thereof for carrying out the invention will become more apparent from reading the following description of a preferred embodiment and perusing the associated drawings in which:

DETAILED DESCRIPTION OF THE PRESENT INVENTION

Figure 1:
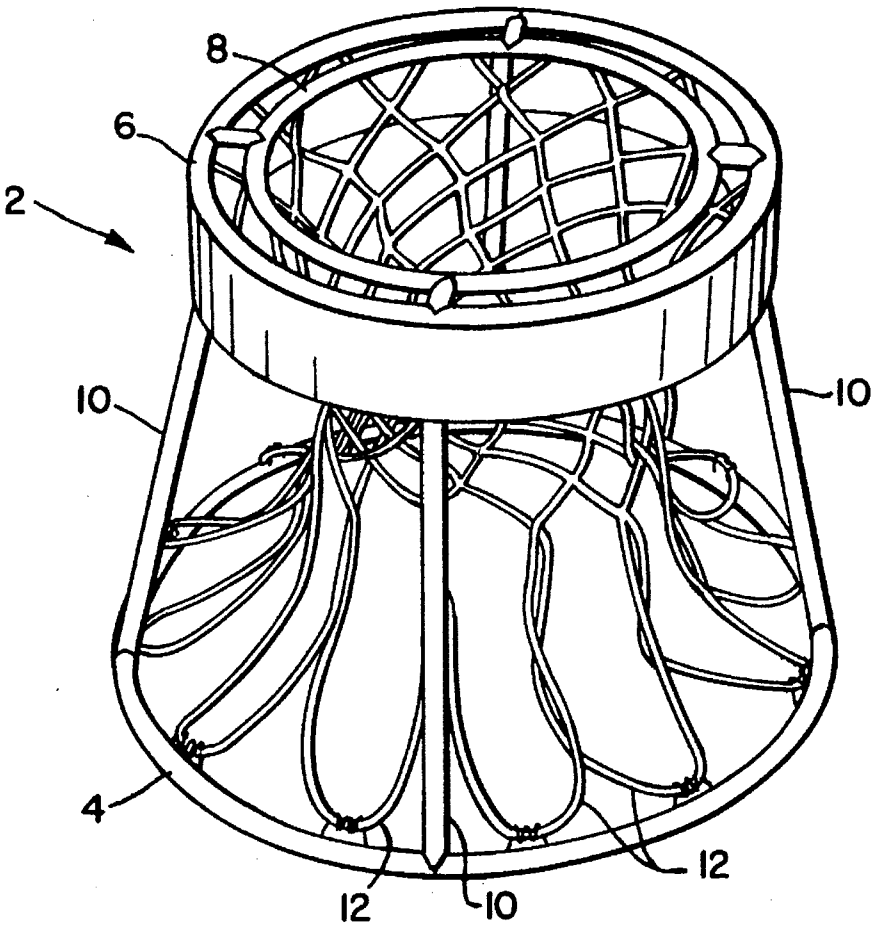
FIG. 1 is a perspective view of the lower hoop structure employed in the present invention illustrating all three hoops of the lower hoop structure.

Referring to FIG. 1 of the accompanying drawings, there is provided a lower hoop structure 2 comprising a regulation size rim 4 lying at one end of the structure and illustrated as standing on a floor. The hoop structure has two other hoops 6 and 8 located at the other end of the structure the hoop 6 being the larger of the two and the hoop 8 being supported within hoop 6 and horizontally aligned therewith.

The hoop 6 is supported by rigid ribs 10 extending upwardly from hoop 4 at a distance above hoop 4 approximately equal to the vertical drop of the netting from a regulation basketball hoop. Netting 12 of the type employed with a standard hoop is strung between hoops 4 and 6.

The hoop 4 is a regulation size hoop, 18" diameter; the hoop 6 has a 13" diameter and the hoop 8 has a 10.5" diameter, this being 1" in diameter greater than a regulation basketball. The structure 2 may employ different diameter hoops.

Figure 2:
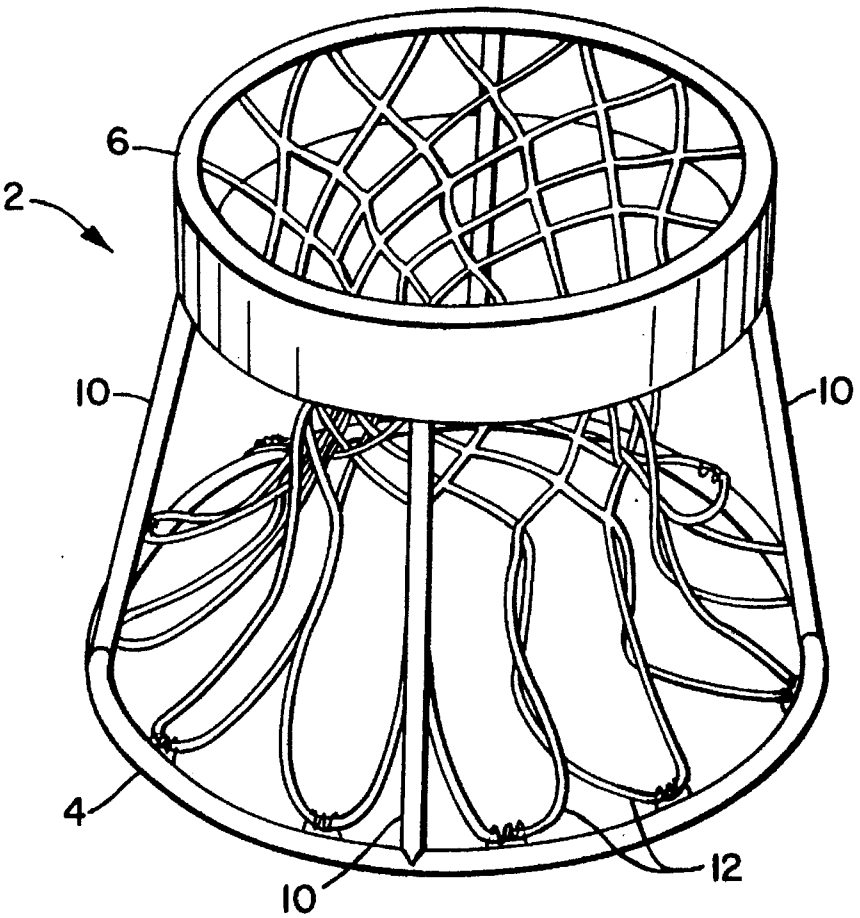
FIG. 2 is a perspective view of the lower hoop structure with the smallest hoop removed.

Referring to FIG. 2 of the accompanying drawings, there is illustrated the hoop structure 2 with the hoop 8 removed. The hoop 8 when used is retained inside of hoop 6 by screws or other suitable removable devices that do not extend all the way through the metal rim of the hoop 8, specifically do not extend into the open region inside of the hoop 8.

Figure 4:
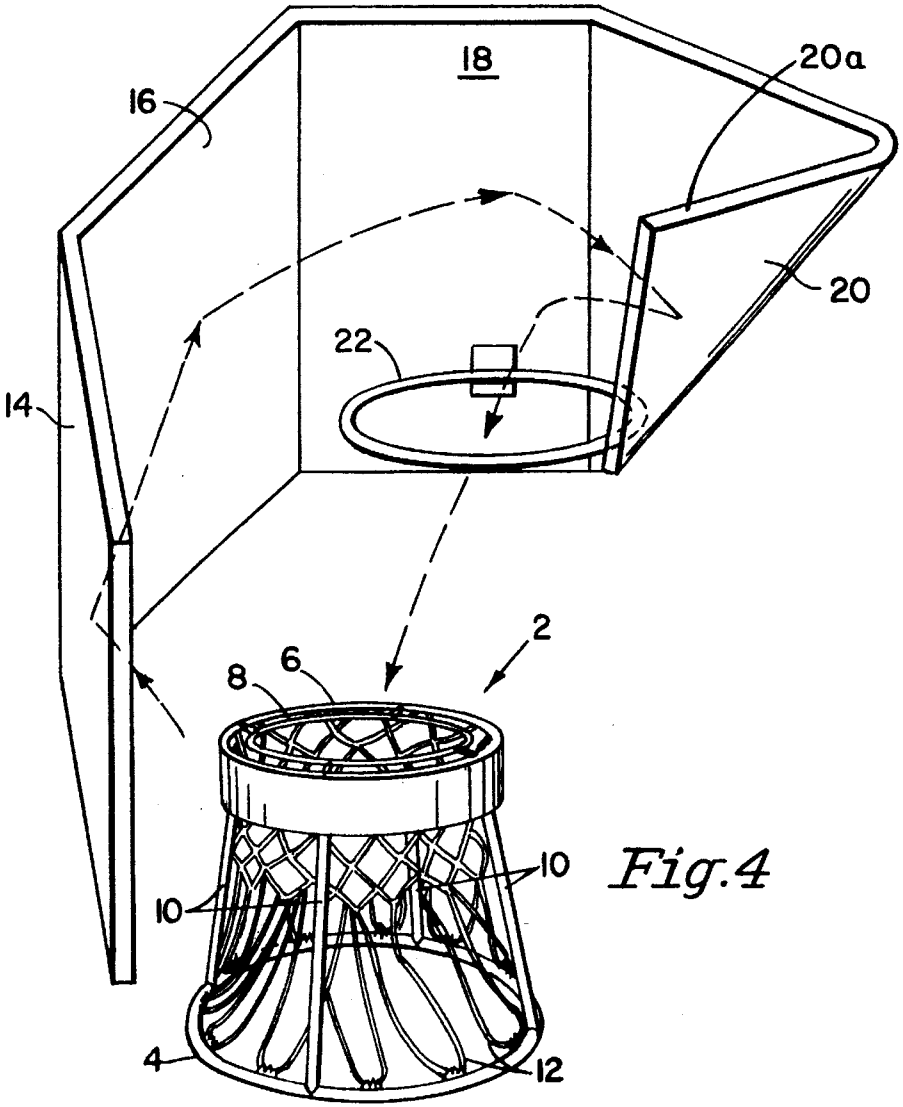
FIG. 4 is a perspective view of the entire structure of the game with the trajectory imposed thereon.
Figure 3:
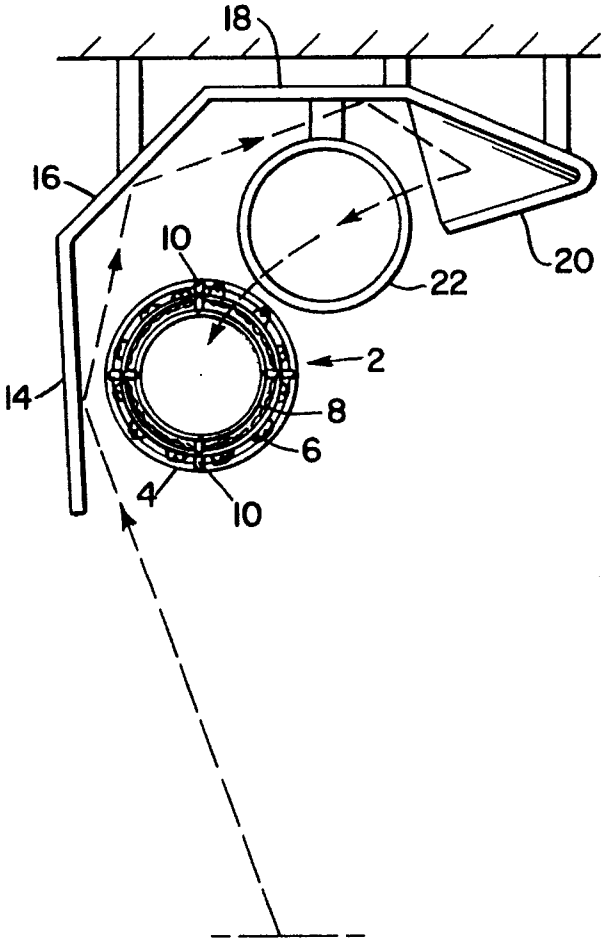
FIG. 3 illustrates a view of the backboard and upper and lower hoops with the trajectory required to achieve a basket illustrated.

Referring now to FIGS. 3 and 4 of the accompanying drawings, there is illustrated a top view of a backboard and upper hoop structure; FIGS. 3 and 4 corresponding respectively to the center element of FIG. 1B and FIG. 9 of the aforesaid patent. The backboard structure comprises three rectangular angularly related panels 14, 16 and 18 and a panel 20 having one corner region 20*a* bent diagonally relative to the rest of the panel 20 and towards a regulation hoop 22. The hoop 22 is disposed at 7 to 10 feet from the floor of the structure supporting the backboard panels 14, 16, 18 and 20. The net is removed from the hoop 22 so that only the rim remains. Removal of the net is required so that a ball entering hoop 22 may retain the trajectory to the hoop structure 2 at which it enters the hoop 22. Otherwise the ball could only fall substantially straight down.

The hoop structure 2 is illustrated in both of FIGS. 3 and 4 as disposed on the floor in a position that a ball proceeding through hoop 22 may enter structure 2. The hoop structure 2 is not confined to a single location since by causing the basketball to strike the different backboards and the region 20*a* at different angles the basketball may enter structure 2 at different locations.

Referring again to FIGS. 3 and 4 the play of the game is described. The hoop structure 2 is placed with the hoop structure 2 on the floor at a location decided by the player. The rules of the game are flexible but the game is normally played requiring that all panels 14, 16, 18 and flap 20*a* be struck by the ball. Thus normally the ball is thrown so as to strike panels 14, 16 and 18 and flap 20*a* in that order. The object is to have the ball pass through the hoop 22 along a trajectory such that it enters the hoop structure 2.

It is noted that the hoop structure 2 as illustrated in FIGS. 3 and 4 must be located to the left, as viewed in the Figures, of the hoop 22. The smaller the hoop of structure 2 presented to the ball the more difficult the shot.

A mirror image of the structure of FIG. 3 may be provided so that shots to a hoop structure to both sides of hoop 22 may be practiced such structure being illustrated as the center group of structures of FIG. 1B of the aforesaid patent. It should be noted that the specific number of backboard panels may be more or less than three and may be curved or flat in order to vary the complexity of the game.

Once given the above disclosure, many other features, modifications and improvements will become apparent to the skilled artisan. Such features, modifications and improvements are, therefore, considered to be a part of this invention, the scope of which is to be determined by the following claims.

I claim:

1. A basketball shot making game structure comprising a backboard structure located above a ground surface, and having a plurality of backboards, and a hoop structure comprising a plurality of hoops, a first hoop being of regulation diameter located at one end of said structure, at least a second hoop located at the other end of said structure and supported at a predetermined distance from said first hoop, and said second hoop being of smaller diameter than said first hoop and coaxial therewith.

2. A basketball shot making game structure according to claim 1 comprising a third hoop coaxial with and removably supported by said second hoop and of smaller diameter of said second hoop.

3. A basketball shot making game structure according to claim 1 wherein said backboard structure includes a hoop without netting located at a predetermined distance from the ground surface and in a position for a basketball bouncing off of a backboard permitting entry into said hoop without netting.

4. A basketball shot making game structure according to claim 3 wherein said hoop structure is located on said ground surface with a hoop at one end of the hoop structure located along a trajectory of a basketball falling through said hoop without netting.

5. A basketball shot making game structure according to claim 1 wherein said backboard structure comprises a plurality of angularly related panels and a netless hoop located relative to said panels so that upon impacting a basketball serially upon said panels the ball may proceed through the netless hoop and into said hoop structure.

6. A basketball shot making game structure comprising a backboard structure located above a playing surface, said backboard structure comprising a plurality of backboard panels serially arranged and angularly positioned relative to one another and a netless hoop, the last of the panels in the series having a diagonally disposed flap, said netless hoop being positioned such that a basketball bounced off of said flap may proceed through said hoop, and a hoop structure having a plurality of coaxial hoops of different diameters located on the playing surface with one of said hoops of a given diameter facing upwardly in a position such that a properly directed basketball may enter said one of said hoops after passing through said netless hoop.

7. A basketball shot making game structure according to claim 6 wherein said hoop structure comprises a first hoop of regulation size located at one end of said structure, a second hoop of lesser diameter than said first hoop, and means for supporting said second hoop coaxial with said first hoop and displaced therefrom a predetermined distance.

8. A basketball shot making game structure according to claim 7 comprising at least a third hoop of lesser diameter than said second hoop coaxial of and in the plane of said second hoop.

9. A basketball shot making game structure according to claim 8 wherein the diameter of said third hoop is approximately one inch greater than the diameter of a regulation basketball.

10. A basketball shot making game structure according to claim 7 wherein said second hoop is located a regulation net length from said first hoop.

* * * * *